US009488376B2

(12) United States Patent
Gerenabarrena Meabebastxea et al.

(10) Patent No.: US 9,488,376 B2
(45) Date of Patent: Nov. 8, 2016

(54) IGNITION SWITCH ASSEMBLY FOR A GAS TAP

(71) Applicant: COPRECITEC, S.L., Aretxabaleta (ES)

(72) Inventors: Unai Gerenabarrena Meabebastxea, Eibar (ES); Ruben Mateos Martin, Marietta, GA (US); Arturo Omar Ceron Varela, Jalisco-Zapopan (MX)

(73) Assignee: COPRECITEC, S.L., Aretxabaleta (ES)

( * ) Notice: Subject to any disclaimer, the term of this patent is extended or adjusted under 35 U.S.C. 154(b) by 500 days.

(21) Appl. No.: 14/094,267

(22) Filed: Dec. 2, 2013

(65) Prior Publication Data

US 2014/0162200 A1 Jun. 12, 2014

(51) Int. Cl.

| | |
|---|---|
| ***F23Q 7/12*** | (2006.01) |
| ***F24C 3/10*** | (2006.01) |
| ***H01H 3/02*** | (2006.01) |
| ***H01H 19/62*** | (2006.01) |
| *F23N 1/00* | (2006.01) |
| *F23N 5/24* | (2006.01) |

(52) U.S. Cl.
CPC ..... *F24C 3/103* (2013.01); *H01H 3/0206* (2013.01); *H01H 19/62* (2013.01); *F23N 1/007* (2013.01); *F23N 5/247* (2013.01)

(58) Field of Classification Search
CPC ..... H01H 3/0206; H01H 19/62
USPC ..... 431/256; 251/116; 126/39 R, 39 BA, 126/39 E; 200/334, 569, 61.86
See application file for complete search history.

(56) References Cited

U.S. PATENT DOCUMENTS 2,880,936 A * 4/1959 Jackson ..... F23N 5/027 137/614.17
3,821,502 A 6/1974 Joeckel
(Continued)

FOREIGN PATENT DOCUMENTS

GB 332158 7/1930
GB 486291 A 4/1938
(Continued)

OTHER PUBLICATIONS

European Search Report mailed Apr. 21, 2016 in corresponding European Application No. 13382456.5-1605.

*Primary Examiner* — Avinash Savani
*Assistant Examiner* — Vivek Shirsat
(74) *Attorney, Agent, or Firm* — Edell, Shapiro & Finnan LLC

(57) ABSTRACT

An ignition switch assembly suitable for being connected to a rotary shaft of a gas tap of a cooking appliance. According to one implementation the ignition switch includes a coupling element through which the ignition switch assembly is coupled to the rotary shaft, the coupling element being rotational with the rotary shaft. A fixed contact element and a movable contact element are provided within a casing of the assembly along with the coupling element which includes a cam on an outside surface thereof. The movable and fixed contact elements and the coupling element are arranged so that the cam urges the moveable contact element into contact with the fixed contact element when the coupling element is rotated between a selective angular range. A resistance element is arranged to contact at least a portion of the body of the coupling element to provide resistance against the rotational movement of the coupling element.

18 Claims, 4 Drawing Sheets

(56) References Cited

U.S. PATENT DOCUMENTS

| | | | | |
|---|---|---|---|---|
| 4,019,855 | A * | 4/1977 | Camillo | H01H 3/0206 126/39 E |
| 4,371,764 | A | 2/1983 | Runion | |
| 5,525,771 | A | 6/1996 | Lund | |
| 6,435,446 | B1 * | 8/2002 | Matsuzawa | B65H 16/00 242/422.4 |
| 2010/0035195 | A1 | 2/2010 | Querejeta Andueza et al. | |
| 2012/0090595 | A1 * | 4/2012 | Shaffer | F23D 14/06 126/39 E |

FOREIGN PATENT DOCUMENTS

| | | |
|---|---|---|
| GB | 1314301 | 4/1973 |
| GB | 2213914 A | 8/1989 |

* cited by examiner

IGNITION SWITCH ASSEMBLY FOR A GAS TAP

CROSS-REFERENCE TO RELATED APPLICATIONS

This application relates to and claims the benefit and priority to Spanish Patent Application No. 201231287, filed Dec. 3, 2012.

TECHNICAL FIELD

The present invention is related to ignition switch assemblies for gas tap suitable for a cooking appliance.

BACKGROUND

Gas taps suitable for a cooking appliance are known comprising a tap body with a conical internal housing suitable for receiving a conical rotational member for regulating gas flow, a manually operated rotary shaft coupled to the conical regulating member, and an ignition switch assembly that is operated when the user turns the rotary shaft in any of the directions of rotation, causing ignition of the flame at least when turning in one of the directions of rotation.

Safety rules for operating gas taps require that to open the gas flow passage, at least two maneuvers must be performed first, such as pushing on the rotary shaft and subsequently turning it, driving the conical regulating member until opening the gas flow.

U.S. Publication No. 2010/035,195 A1 discloses a gas tap with an ignition switch assembly suitable for a cooking appliance, comprising a rotary shaft, an ignition switch assembly coupled to the rotary shaft, the ignition switch assembly including a fixed contact means and a movable contact means, a coupling element through which the ignition switch assembly is coupled to the rotary shaft, the coupling element being rotational and integral with the rotary shaft in a rotational movement, and a cam coupled to the rotary shaft through the coupling element, shifting the movable contact means towards the fixed contact means, electrical contact being produced when the coupling element is turned in one direction.

SUMMARY OF THE DISCLOSURE

According to some implementations an ignition switch assembly is provided suitable for being connected to a rotary shaft of a gas tap. According to some implementations the assembly comprises a fixed contact element and a movable contact element, a coupling element through which the ignition switch assembly is coupled to the rotary shaft, the coupling element being rotational and integral with the rotary shaft in a rotational movement, and a cam coupled to the coupling element and arranged to act upon at least a portion of the movable contact element to shift it towards the fixed contact element when the coupling element is rotated. According to some implementations when the gas tap is being opened to permit a gas flow therethrough, the cam acts on the moveable contact element to cause it to make electrical contact with the fixed contact element to close a circuit for delivering power to a spark generator. According to some implementations when the gas tap is being closed the cam acts on the moveable contact element to cause it to shift towards the fixed contact element without contact being established between the moveable and fixed contact elements.

According to some implementations the ignition switch assembly comprises at least one resistance means other than the cam. The resistance means functions to resist against the rotational movement of the rotary shaft, making the force that a user must exert to turn the rotary shaft greater than what would otherwise be required without the existence of the resistance means. According to some implementations the resistance provided by the resistance means is different from the resistance put forth by the cam when the cam acts upon the movable contact element. According to some implementations the resistance provided by the resistance means is greater than the resistance put forth by the cam when the cam acts upon the movable contact element. According to the latter implementation the contact of the cam on the movable contact element is gentle and is not designed to resist against rotational movement of the coupling element. A safety measure against accidental movements of the rotary shaft is added by the resistance means which may be augmented to comply with applicable safety regulations. Accidental movements that can be caused by the user can include the user unintentionally supporting against or turning the shaft of the taps, or in the case of children, movements caused while playing. The inclusion of the resistance means beneficially hinders such accidental movements.

These and other advantages and features will become evident in view of the drawings and the detailed description.

DETAILED DESCRIPTION

Figure 1:
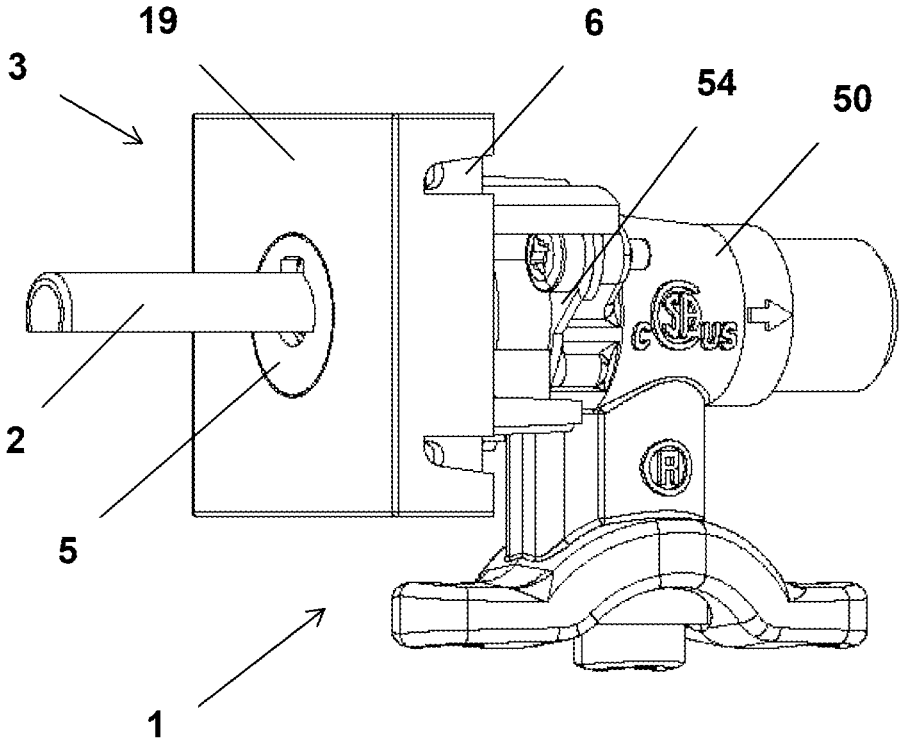
FIG. 1 shows a perspective view of an ignition switch assembly connected to a rotary shaft of a gas tap according to an implementation.

FIG. 1 shows a perspective view of an ignition switch assembly 3 connected to a rotary shaft 2 of a gas tap 1 according to an implementation. The ignition switch assembly externally comprises a container comprising a fixed casing 6 where the different elements internally comprised in the ignition switch assembly 3 are located, and a removable cover 19. The ignition switch assembly is mounted on the rotary shaft 2 of the gas tap 1, and the casing 6 is supported on a cover 54 of the gas tap 1, although it can also be mounted on the tap body 50.

Figure 2:
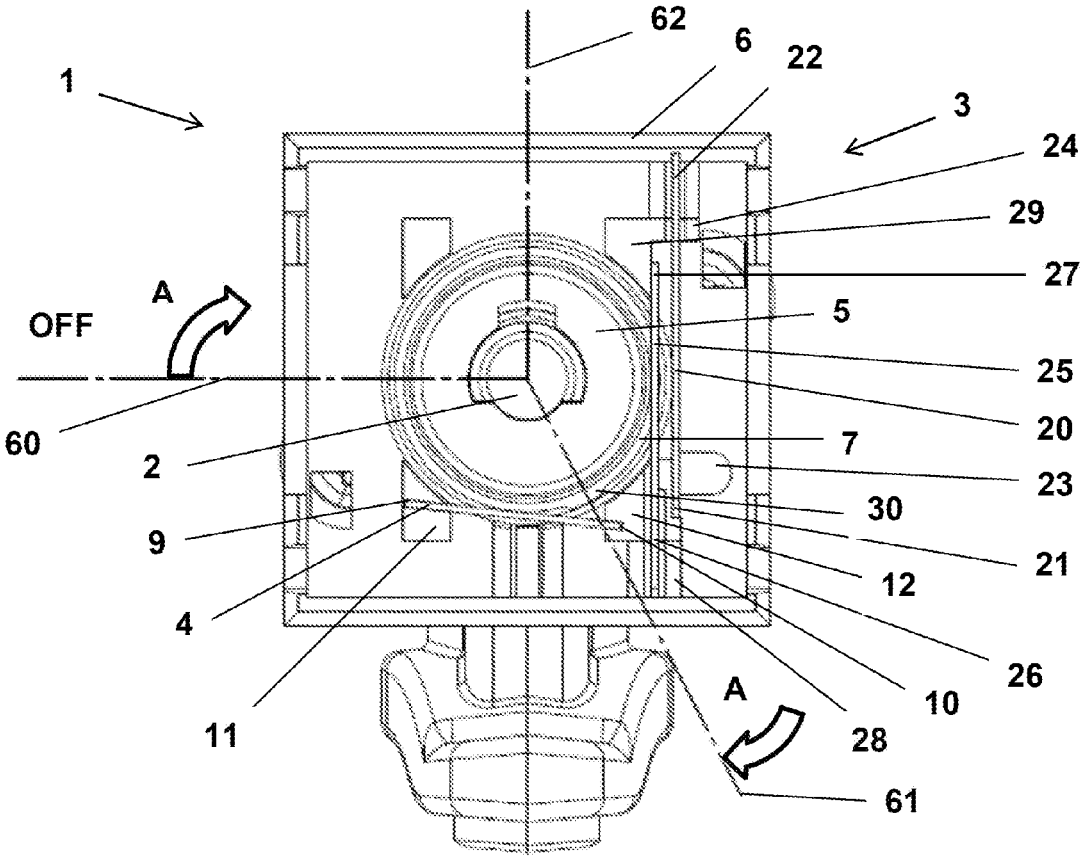
FIG. 2 shows a front view of an implementation of an ignition switch assembly, without a cover and with resistance means in the form of a sheet.

FIG. 2 shows an implementation of an ignition switch assembly 3 with the cover 19 removed. This ignition switch assembly 3 has the function of a switch that opens and closes an electrical circuit that provides power to a spark generator in the form of a spark plug or for firing a spark plug (not shown in the drawings). According to some implementations the ignition switch assembly 3 comprises a fixed contact element 20 and a movable contact element 25, a coupling element 5 comprising a central hole shaped such that it is integral with the rotary shaft 2 in a rotational movement and allows for the axial movement of the shaft 2. The coupling element 5 is coupled to the ignition switch assembly 3 such that it allows the rotational movement thereof together with the rotary shaft 2. The ignition switch assembly 3 also comprises a cam 30 that is coupled to the coupling element 5, the function of the cam 30 when the rotary shaft 2 is turned being to shift the movable contact element 25 towards the fixed contact element 20, achieving contact between the movable contact element 25 and the fixed contact element 20 during a selective range or ranges of rotation of the rotary shaft 2. According to some implementations when the gas tap is being opened the cam 30 acts on the moveable contact element 25 to cause it to make electrical contact with the fixed contact 20 element to close a circuit for delivering power to a spark generator. According to some implementations when the gas tap is being closed the cam 30 acts on the moveable contact element 25 to cause it to shift towards the fixed contact element 20 without contact being established between the moveable and fixed contact elements.

When contact between the movable contact element 25 and the fixed contact element 20 is made by means of the cam 30 on the coupling element 5, resistance against the turning of the rotary shaft 2 is produced, though it is very gentle. Although such resistance may comply with the regulatory requirement of there being at least two maneuvers for being able to open the gas tap, the user may not perceive it as a deterrent force in the event of possible accidents. For this reason the ignition switch assembly 3 includes at least one resistance means 4, other than the cam 30, that resists against the rotational movement of the rotary shaft 2.

The resistance means 4 may be arranged inside the ignition switch assembly 3, the ignition switch assembly 3 comprising a casing 6 fixed to the outside of the gas tap 1 on the cover 54 by means of supports projecting from the rear portion of the casing 6. The ignition switch assembly 3 can also be supported on the gas tap 1 by means of the tap body. The resistance means 4 may be located inside the casing 6 supported such that it can be considered to be anchored in the casing 6.

The rotary shaft 2 and the coupling element 5 can rotate an angle A in either of the two directions, usually greater than 160°, for the gas flow G supply. The angle of rotation A is from an initial position 60 of rotation, corresponding to the closed OFF position of the gas flow supply, to a final position 61 corresponding to a minimum gas flow, passing through an intermediate position 62 for maximum gas flow supply, as shown in FIG. 2.

Figure 6:
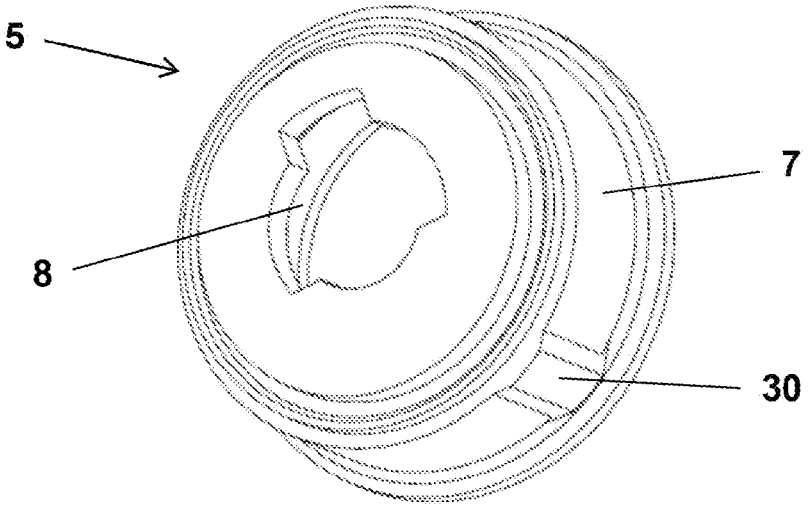
FIG. 6 shows a perspective view of an implementation of the coupling element of the ignition switch assembly.

The resistance means 4 is arranged to make contact with the coupling element 5 in at least one section of the angle of rotation A, resisting against the rotational movement of the rotary shaft 2. FIG. 6 shows a perspective view of an implementation of the coupling element 5. According to one implementation the coupling element 5 comprises a body having a substantially cylindrical shape, with a central hole that allows the coupling thereof to the rotary shaft 2. The coupling element has a curved outer side surface 7, and at its lower end it comprises a wing-shaped edge, the edge and the side surface 7 allowing the fitting of the coupling element 5 in the supports of the casing 6, such that the element 5 can turn in the supports of the casing 6. The coupling element 5 also includes a curved inner side surface 8.

The implementation of FIG. 2 shows a front view of the ignition switch assembly 3 in which the front cover 19 of the ignition switch assembly 3 has been removed, showing the inside of the casing 6. According to one implementation the resistance means 4, which is located inside the casing 6, is a substrate in the form of a thin planar sheet with a width equal to or less than that of the side surface 7 of the coupling element 5. The sheet 4 is attached at its two ends 9, 10 to two respective supports 11, 12 of the casing 6, this attachment being performed according to some implementations with slots in the supports 11, 12 that allow removing the sheet 4 for its possible replacement. According to some implementation the sheet 4 is arranged such that the sheet 4 is constantly in contact with the side surface 7 of coupling element 5. According to other implementation the fixing of the sheet 4 is arranged such that the sheet 4 is in contact with the side surface 7 of coupling element 5 only at selective angular positions of the coupling element 5. According to some implementations at least the upper surface of the sheet comprises a high friction material for contacting with the coupling element 5. This can be accomplished by coating the upper surface of the sheet with a high friction material or by surface treating the upper surface to form a rough surface. According to some implementations the sheet itself may be made of a high friction material such as, for example, rubber. Therefore, when the rotary shaft 2 is turned, the coupling element 5 turns integrally therewith, and when the side surface 7 slides over the sheet 4 a friction force is established to resist against the rotational movement of the rotary shaft 2. According to some implementations the resistance against the rotational movement is produced throughout the entire angle of rotation A, and in the direction for both opening and for closing the gas tap 1. According to other implementations the resistance is provided only during one or more selected ranges of angular rotation of the rotary shaft 2 and/or only in the rotational direction for opening the gas tap 1.

Figure 3:
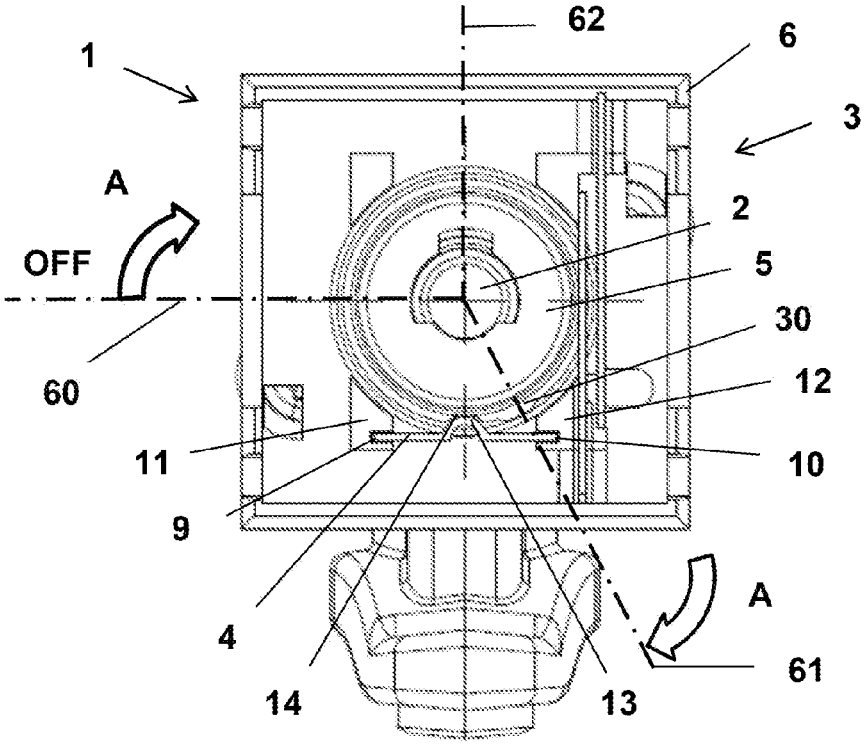
FIG. 3 shows a front view of another implementation of an ignition switch assembly, without a cover and with resistance means in the form of a sheet with a protuberance.

FIG. 3 shows an implementation of the ignition switch assembly 3 with a resistance means 4 in the form of a sheet with a protuberance 13. FIG. 3 shows a front view of the ignition switch assembly 3 in which the front cover 19 of the ignition switch assembly 3 has been removed showing the inside of the casing 6. The ignition switch assembly 3 generally includes the elements described in the implementations of FIG. 2 with the difference being in the resistance means 4. In the implementation of FIG. 3 the resistance means 4 comprises a thin planar sheet with a protuberance 13 arranged along its length. As shown in FIG. 3, according to one implementation the protuberance 13 has a semi-cylindrical shape and is located substantially in the center of the sheet 4. It is appreciated, however, that as long as the protuberance 13 is situated to make contact with the side surface 7 of the coupling element 5 that the protuberance 13 may comprise other shapes and may be located anywhere along the length of the sheet 4. According to some implementations the width of the protuberance 13 coincides substantially with the width of the sheet 4 and/or the width of the side surface 7 of the coupling element 5. The coupling element 5 comprises on its side surface 7 a housing 14, such as a groove, indentation, or the like, for receiving the protuberance 13. According to one implementation the housing 14 has a semi-cylindrical shape with about the same dimensional characteristics as the protuberance 13, such that at least a portion of the protuberance 13 is arranged in the housing 14 when the rotary shaft 2 is located in the initial closed OFF position 60 of the gas flow. When the user opens the gas tap 1, he/she turns the rotary shaft 2 and encounters considerable resistance due to the protuberance 13 of the sheet 4 residing in the housing 14. To overcome the resistance the user has to exert an additional amount of force sufficient for removing the protuberance 13 from the housing 14, and when continuing with turning, and preferably from the intermediate position 62 corresponding to a maximum flow, the protuberance 13 continues contacting with the side surface 7 to produce a friction force that resists against the rotational movement of the rotary shaft 2. According to some implementations the initial resistance against the rotational movement while the protuberance 13 is moved out of the housing 14, and the continued resistance while the shaft 2 is turned, are produced during the entire angle of rotation A, and in the direction for both opening and for closing of the rotary shaft 2. According to some implementations the coupling element 5 and resistance means 4 are configured such that the initial resistance is greater than the continued resistance. The support of the sheet 4 in the casing 6 of the ignition switch assembly 3 may be similar to that shown in the implementation of FIG. 2, the ends 9, 10 of the sheet being supported in slots of the supports 11, 12 of the casing 6, allowing the removal thereof. Likewise, the material of the sheet 4 and its finish may have the same technical features as those described above for the implementation of FIG. 2. According to other implementations the resistance is provided by the protuberance 13 only during one or more selected ranges of angular rotation of the rotary shaft 2 and/or only in the rotational direction for opening the gas tap 1.

Figure 4:
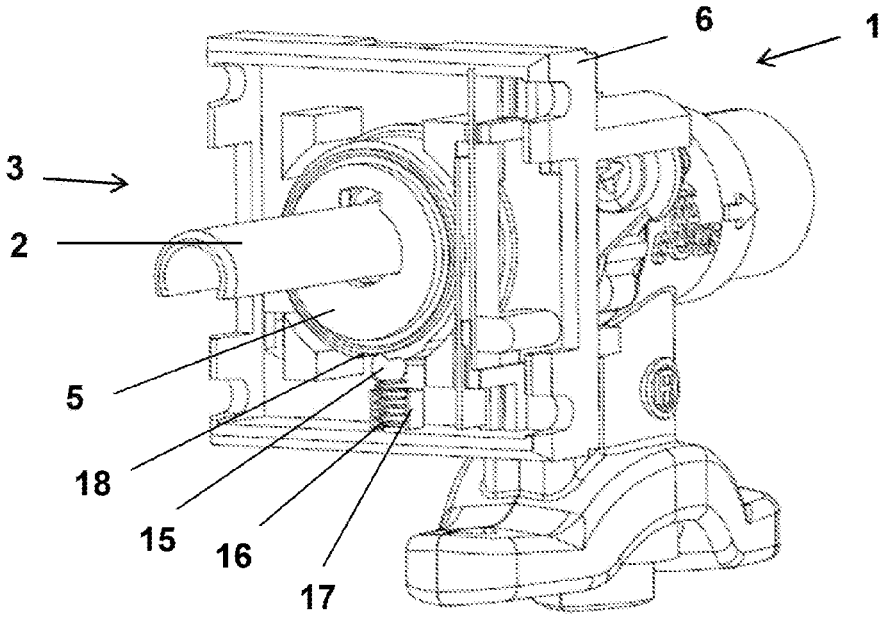
FIG. 4 shows a perspective view of another implementation of an ignition switch assembly, without a cover and with resistance means in the form of an assembly formed by a ball and a spring.

FIG. 4 shows another implementation of the ignition switch assembly 3 with a resistance means 4 in the form of an assembly formed by a ball 15 and a spring 16. FIG. 4 shows a perspective view of the ignition switch assembly 3 in which the front cover 19 of the ignition switch assembly 3 has been removed, showing the inside of the casing 6. The ignition switch assembly 3 generally comprises the elements described in the implementations of FIGS. 2 and 3, with the difference being the resistance means 4 and the means required for housing the same in the casing 6. According to some implementations the resistance means 4 is an assembly formed by a ball 15 supported by a spring 16. According to some implementations the ball 15 and spring 16 are arranged in a substantially vertical position as shown in FIG. 4. The spring 16 may be arranged in a housing 17 of the casing 6 allowing its axial shift. The housing 17 may be a groove formed partially in the portion of the casing 6 where the coupling element 5 and the supports allowing its turning are arranged, with the other portion of the groove 17 being arranged in the cover of the casing 6 (not shown in the drawing), such that when the casing 6 is closed with the cover the groove 17 is completed. According to one implementation the coupling element 5 comprises on its side surface 7 a semi-spherical shaped housing 18 for accommodating at least a portion of the ball 15, and in some instances having about the same dimensional characteristics as the ball 15, such that the ball 15 is arranged in the housing 18 due to the force exerted by the spring 16 when the rotary shaft 2 is located in the initial closed OFF position 60 of the gas flow. In this implementation the angle of rotation A of the rotary shaft 2 is substantially the same as that shown in the implementation of FIG. 2, with the same defined initial position 60, final position 61 and intermediate position 62. When the user opens the gas tap 1 and turns the rotary shaft 2, he/she encounters considerable resistance due to housing the ball 15 of the assembly of the resistance means 4 in the housing 18. The user has to exert a force that allows removing the ball 15 from the housing 18, and when continuing with turning, and preferably from the intermediate position 62 corresponding to maximum flow, the ball 15 continues contacting with the side surface 7, producing a friction force in the ball 15 that resists against the rotational movement of the rotary shaft 2. According to some implementations this initial resistance against the rotational movement while the ball 15 is moved out of the housing 18, and the continued resistance while the shaft 2 is turned, are produced during the entire angle of rotation A, and in the direction for both opening and for closing of the rotary shaft 2. In such an implementation contact between the ball 15 and the side surface 7 is generally produced at one point, so the produced friction force may be less than the friction force resulting in the implementation of FIG. 3. When the gas tap 1 is closed by arranging the rotary shaft 2 in position 60, both in the implementation of FIGS. 3 and 4, the housings 14 and 18, respectively, facilitate the positioning of the ball 15 and the protuberance 13, respectively, adding a click-like sound indication. The material used to manufacture the spring 16 may be the material normally used and referred to as spring steel, and the material of the ball 15 can be plastic or other materials such as, for example, stainless steel.

Figure 5:
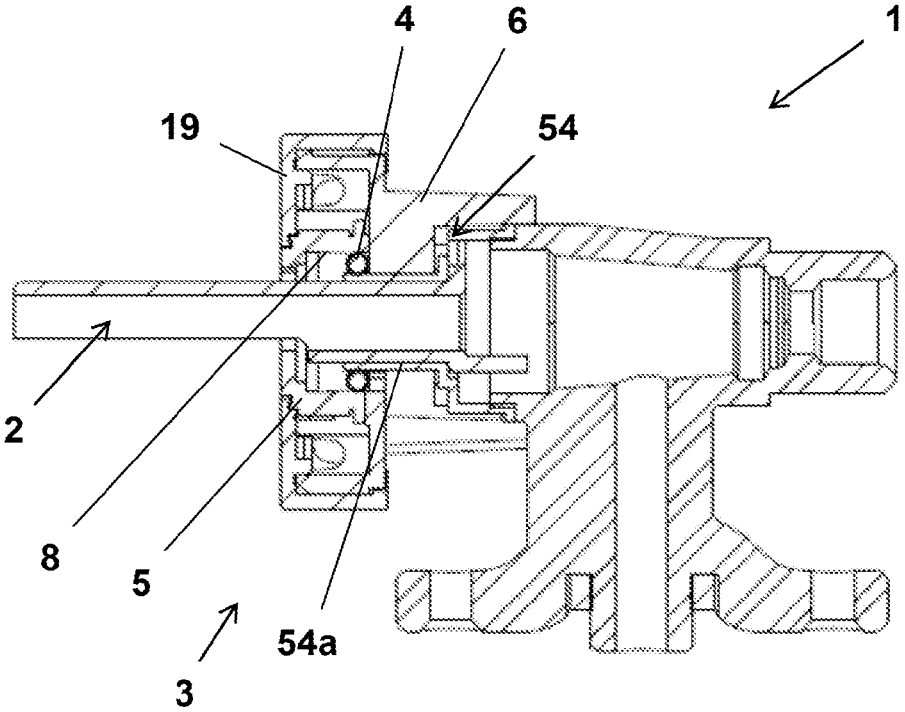
FIG. 5 shows a longitudinal section view of another implementation of an ignition switch assembly, with resistance means in the form of a gasket.

FIG. 5 shows another implementation of an ignition switch assembly 3 with a resistance means 4 in the form of a gasket. FIG. 5 shows a side sectioned view of the gas tap 1 with the ignition switch assembly 3 mounted. The ignition switch assembly 3 generally comprises the elements described in the implementations of FIGS. 2, 3 and 4, with the difference being the resistance means 4 and the means required for housing the same in the casing 6 and the gas tap 1. In the implementation of FIG. 5 the resistance means 4 is a gasket arranged inside the coupling element 5. The gasket may be an elastomeric O-ring residing in the coupling element with a first side of the O-ring supported on one side against the casing 6 of the ignition switch assembly 3 as shown in FIG. 5. The cover 54 of the gas tap 1 comprises a tubular portion 54*a* surrounding and fitting with the diameter of the rotary shaft 2, guiding it in its rotation. The inner diameter of the O-ring gasket 4 acts against and surrounds the outer diameter of the tubular portion 54*a*, being fitted to it. The outer diameter of the O-ring gasket 4 acts against the inner surface 8 of the coupling element 5. When the user opens the gas tap 1 and turns the rotary shaft 2 from the initial position OFF 60 to the final position 61, and in both directions of rotation, a friction force is produced in the gasket 4 that resists against the rotational movement of the rotary shaft 2. The angle of rotation A of the rotary shaft 2 may be substantially equal to that described in the implementations of FIGS. 2, 3 and 4, with the same defined initial position 60, final position 61 and intermediate position 62. The gasket 4 may comprise an elastomeric material having elasticity, durability and resistance properties suitable for this application. According to the arrangement of FIG. 5 there exist friction between the gasket 4 and the tubular portion 54*a* of the cover 6, as well as between the gasket 4 and the coupling element 5, and depending on the tight fit between the gasket 4 and the tubular portion 54*a* of the cover 6, this friction is greater than the friction existing with the coupling element 5, the gasket 4 remaining fixed and brushing against the inner side surface 8 of the coupling element 5 in the gasket 4, producing resistance against the rotational movement of the coupling element 5, and hence shaft 2.

In FIGS. 2 to 5, the cam 30 may be part of the coupling element 5, being integral with the element 5 since the cam 30 is arranged on the outer side surface 7, taking up the width of the outer side surface 7 and protruding radially from the outer side surface 7 sufficient enough so that it can contact with the movable contact element 25 when the coupling element 5 is rotated within a selective angular range. As shown in FIG. 2, but being extensible to the implementations of FIGS. 3, 4 and 5, the ignition switch assembly 3 comprises inside the casing 6 the fixed electrical contact element 20 which is attached at its two ends 21, 22 to two respective supports 23, 24 of the casing 6. The ignition switch assembly 3 also internally comprises the movable electrical contact element 25 attached at one end 26 to a support 28 of the casing 6, and at the other end 27 resting on a support 29 of the casing 6. Since the cam 30 is part of the coupling element 5, when the rotary shaft 2 is operated by the user and turns in the angle of rotation A in either direction, it is able to make contact with and push against the movable contact element 25, and since the end 27 of the movable contact element 25 is rest on the support 29 of the casing 6, it shifts and contacts with the fixed contact element 20. This contact closes an electric circuit and causes the spark generator to generate sparks in the spark plug (not shown in the drawings). The generation of sparks may be produced when the rotary shaft 2 turns in both directions, i.e., the direction for opening and for closing the gas tap 1, but it is not limiting. According to other implementations the coupling element 5 and cam 30 are configured and arranged to cause contact between the movable contact element 25 and the fixed contact element 20 only when the rotary shaft 2 is rotated in the direction for opening the gas tap 1.

In any of the implementations of FIGS. 2 to 5, the rotary shaft 2 may turn the angle of rotation A from an initial OFF position 60, located at 0°, to a final position 61 corresponding to a minimum gas flow, located between about 160° and between about 270°, a final position 61 of about 210° being shown in FIG. 2. The rotation of the angle A in opening is towards the left and passes through an intermediate position 62 corresponding to a maximum gas flow, located at about 90°. According to some implementations when the gas tap 1 is opened, the gas is regulated, the gas flow starting to open in a position corresponding to an angle of about 30°. However, the user turns the rotary shaft 2 to the position 62 of maximum gas flow and keeps it in the position until the sparks generated by the spark plug produce the flame. Therefore, when the gas flow starts to open in the position of 30°, it is necessary for sparks to be generated, and to that end the cam 30 of the coupling element 5 contacts with the movable contact element 25 between an angle of about 20° and an angle of about 85°. A sufficiently large section of the angle of rotation A of 20° to 85° is thus obtained so that flame can be generated from the position of 30° in which there is already gas flow, and the user can stop pressing on the rotary shaft 2 in the position 62 of maximum gas flow due to the initiation of the opening of the gas tap 1, and can then regulate the position of the shaft 2 where needed.

Different implementations of the ignition switch assembly 3, which can be mounted indistinctly in a gas tap 1 for a cooking appliance of the type comprising a tap body 50 with a conical internal housing suitable for receiving a conical rotational member for regulating gas flow, a manually operated rotary shaft 2 coupled to the conical regulating member, and a cover 54 covering the housing of the tap body 50, are thus obtained.

What is claimed is:

1. An ignition switch assembly suitable for being connected to a rotary shaft of a gas tap of a cooking appliance comprising:

a fixed contact element, a movable contact element, a rotating coupling element through which the ignition switch assembly is coupled to the rotary shaft of the gas tap, the coupling element including a body having an outer side surface, the outer side surface comprising a radially protruding cam integrally formed therewith or attached thereto, the coupling element and cam are configured and arranged so that the cam acts upon the movable contact element to place the movable contact element in electrical contact with the fixed contact element when the coupling element is rotated between a selective angular range; and a resistance element arranged to contact at least a portion of the body of the coupling element to provide resistance against the rotational movement of the coupling element, the resistance against rotational movement of the coupling element provided by the resistance element being greater than a resistance against rotational movement of the coupling element provided by the cam when the cam acts upon the movable contact element.

2. An ignition switch assembly according to claim 1, wherein the coupling element is configured to turn with the rotary shaft about an angle of rotation from an initial position corresponding to a closed OFF position of the gas tap, to a final position corresponding to a specific gas flow of the gas tap, the resistance element being in contact with the body of the coupling element in at least one portion of the angle of rotation.

3. An ignition switch assembly according to claim 2, wherein the coupling element comprises a generally cylindrical body having an outer side surface and an inner side surface, the resistance element contacting at least one of the inner and outer side surfaces to provide resistance against the rotational movement of the coupling element.

4. An ignition switch assembly according to claim 3, further comprising a casing suitable for being fixed to the gas tap, the coupling element, the fixed contact element, the movable contact element and the resistance element being housed in the casing.

5. An ignition switch assembly according to claim 4, wherein the resistance element is a substrate fixed in the casing and arranged to contact at least a portion of the outer side surface of the body of the coupling element.

6. An ignition switch assembly according to claim 5, wherein the substrate is a thin planar sheet.

7. An ignition switch assembly according to claim 5, wherein the substrate comprises a protuberance positioned along a length thereof, the coupling element comprising a housing at a location on the outer side surface of the body, the protuberance being arranged in the housing when the coupling element is located in a position corresponding to the initial OFF position, the protuberance making contact with the outer side surface when the coupling element is rotated in the at least one portion of the angle of rotation.

8. An ignition switch assembly according to claim 5, wherein a portion of the substrate that contacts the outer side surface of the coupling element body is made of rubber.

9. An ignition switch assembly according to claim 4, wherein the resistance element is a gasket supported in the casing, the gasket having an inner diameter that surrounds a tubular portion of the gas tap, an outer diameter of the gasket making contact with the inner side surface of the body of the coupling element, the gasket configured to produce a friction force when the coupling element is rotated in the at least one portion of the angle of rotation.

10. An ignition switch assembly according to claim 9, wherein the gasket is made of an elastomeric material.

11. An ignition switch assembly according to claim 4, wherein the resistance element is an assembly formed by a ball supported by a spring, the spring being arranged in a housing of the casing allowing its compression and expansion, the ball being arranged in a housing of the coupling element when the coupling element is located in a position corresponding to the initial OFF position of the gas tap, the ball arranged to make contact with the outer side surface of the body of coupling element when the coupling element is rotated in the at least one portion of the angle of rotation.

12. An ignition switch assembly according to claim 11, wherein the ball is made of a material selected from the group consisting of a metal or a plastic.

13. An ignition switch assembly according to claim 1, wherein the cam and the coupling element are a monolithic structure.

14. An Ignition switch assembly according to claim 4, wherein the fixed contact element comprises a first elongate structure having a first end and a second end, the first and second ends of the fixed contact element being fixed to the casing, and wherein the movable contact element comprises a second elongate structure having a first end and a second end, the first end of the movable contact element being fixed to the casing and the second end of the movable contact element being a free end.

15. An ignition switch assembly according to claim 1, wherein the rotary shaft is capable of being turned an angle of rotation from an initial OFF position located at 0° to a final position corresponding to a minimum gas flow, the angle of rotation between the initial OFF position and the final position being between 160° and 270°, the rotary shaft having an intermediate rotational position corresponding to a maximum gas flow located between the initial OFF position and the final position, the cam contacting the movable contact element between an angle of 20° and an angle of 85° of the rotary shaft.

16. An ignition switch assembly according to claim 15, wherein the intermediate rotational position is located at 90°.

17. An ignition switch assembly according to claim 15, wherein an initial gas flow is established through the gas tap when the rotational position of the rotary shaft is located at 30°.

18. An ignition switch assembly suitable for being connected to a rotary shaft of a gas tap of a cooking appliance comprising:

a casing, a fixed contact element fixed in the casing, a movable contact element fixed in the casing, a rotating coupling element located within the casing through which the ignition switch assembly is coupled to the rotary shaft of the gas tap, the coupling element including an generally cylindrical body having an outer side surface and an inner side surface, the outer side surface comprising a radially protruding cam integrally formed therewith or attached thereto, the coupling element and cam configured and arranged so that the cam acts upon the movable contact element to place the movable contact element in electrical contact with the fixed contact element when the coupling element is rotated between a selective angular range; and a resistance element fixed in the casing and arranged to contact at least a portion of the outer side surface of the coupling element to provide resistance against the rotational movement of the coupling element, the resistance against rotational movement of the coupling element provided by the resistance element being greater than the resistance against rotational movement of the coupling element provided by the cam when the cam acts upon the movable contact element.

* * * * *